US005875712A

United States Patent [19]

Ericsson et al.

[11] Patent Number: 5,875,712

[45] Date of Patent: Mar. 2, 1999

[54] METHODS AND ARRANGEMENT FOR THE PRODUCTION OF A STENCIL BY A MODIFIED LASER PRINTER

[75] Inventors: Sylve Jack Donald Ericsson, Tumba; Ulf Göran Nyman, Västerås, both of Sweden

[73] Assignee: Svecia Screen Printing Systems AB, Norsborg, Sweden

[21] Appl. No.: 875,784

[22] PCT Filed: Feb. 15, 1996

[86] PCT No.: PCT/SE96/00198

§ 371 Date: Aug. 5, 1997

§ 102(e) Date: Aug. 5, 1997

[87] PCT Pub. No.: WO96/25293

PCT Pub. Date: Aug. 22, 1996

[30] Foreign Application Priority Data

Feb. 15, 1995 [SE] Sweden ..... 9500551

[51] Int. Cl.[6] ..... B41M 1/12

[52] U.S. Cl. ..... 101/129; 101/128.4

[58] Field of Search ..... 101/128.4, 129

[56] References Cited

U.S. PATENT DOCUMENTS 4,226,410 10/1980 McIntosh, Sr. et al. ..... 400/613.2
5,156,089 10/1992 McCue et al. ..... 101/128.4
5,274,397 12/1993 Gover ..... 347/139
5,511,477 4/1996 Adler et al. ..... 101/128.4
5,580,698 12/1996 Andersen ..... 101/128.4

FOREIGN PATENT DOCUMENTS 0 590 165 4/1994 European Pat. Off. .

*Primary Examiner*—Ren Yan
*Assistant Examiner*—Daniel J. Colilla
*Attorney, Agent, or Firm*—Burns, Doane, Swecker & Mathis, L.L.P.

[57] ABSTRACT

The present invention refers to a method and a plant for producing a stencil arrangement, whereby said stencil comprises a carrier substrate (2) and a pattern (4) belonging to said substrate, while using digital information relating to a pattern and stored in a computer equipment (10) and means (20) for transferring said digital information to a light-sensitive layer (3) applied onto the carrier substrate (2). Connected to the computer equipment (10) is at least one modified laser printer unit (20), which is movable relative to said layer-coated carrier substrate (2) by means of a frame structure (30). During said movement said unit (20) is applying to a light-absorbing layer (5, 5') onto said light-sensitive layer (3) and further means are arranged for exposure process and development process.

14 Claims, 1 Drawing Sheet

Fig. 1
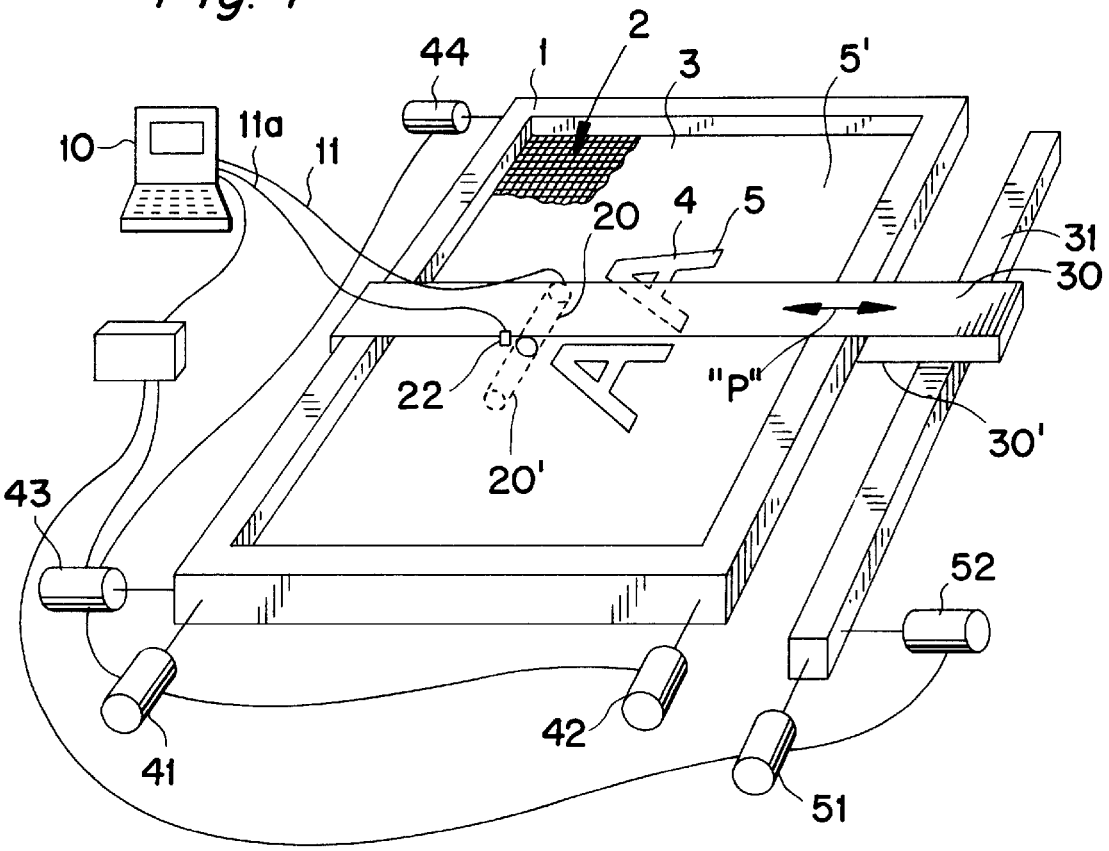
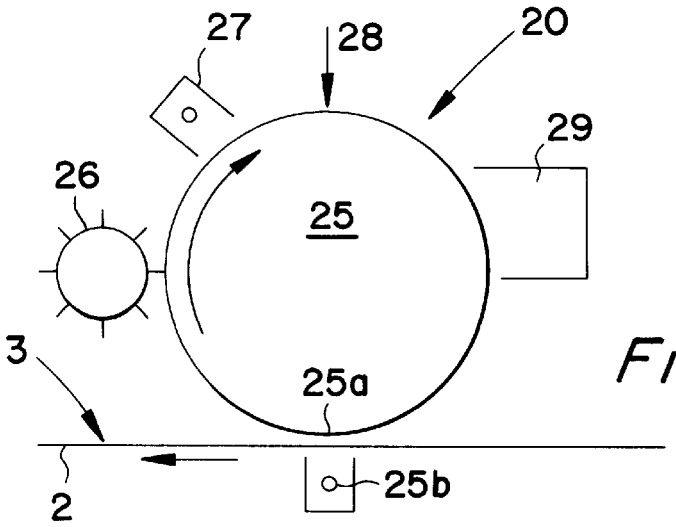
Fig. 2

METHODS AND ARRANGEMENT FOR THE PRODUCTION OF A STENCIL BY A MODIFIED LASER PRINTER

TECHNICAL FIELD

The present invention relates primarily to a method of producing a stencil for use in stencil printing machines for applying to print material a print pattern which corresponds to a pattern formed in the stencil, or for producing an offset plate consisting of electrically insulating material, such as a polyester plate, adapted for use in an offset printer so as to be able to apply to print material a print pattern which corresponds to a pattern formed in the offset plate.

For the sake of simplicity, reference is solely made to a "stencil" in the following description, although the person skilled in this art will be aware of the procedures that are required to enable the invention to be applied adequately in producing a stencil or an offset plate.

The present invention thus relates to a method and apparatus for producing a stencil or the like.

Stencils of the kind to which the present invention refers consist of a stencil frame and a carrier substrate, in the form of a cloth, which is stretched in the frame and which incorporates a pattern.

The invention is effected with the aid of digital information relating to positioning of the pattern and its form on the stencil and stored in computer equipment.

Also used are means connected to said computer equipment and functioning to transfer said pattern-related digital information to a light-sensitive layer applied to the carrier substrate.

BACKGROUND ART

Several different methods of producing a stencil for use in stencil printing machines and different methods for producing offset plates for offset machines are known to the art.

With regard to stencil printing machines, it is known to produce a stencil on the basis of a carrier substrate, such as a cloth stretched in a stencil frame and coated with a special layer of emulsion which forms a light-sensitive layer.

Exposure is effected by illuminating the emulsion layer with a projected image, wherewith illuminated parts of the emulsion layer harden and non-illuminated and non-hardened parts form the pattern, and wherein the non-illuminated and non-hardened parts of the emulsion layer are washed away in a subsequent developing process.

The resultant stencil thus includes exposed pattern-associated parts through which printing paste is able to pass during the printing sequence.

It will be apparent that a method of the aforedescribed kind requires the use of projector equipment, a film as the original, and strong lighting, and that a stencil-producing method of this kind is time-consuming and its associated equipment expensive.

However, the use of large projector equipment enable large stencils to be produced, such as stencils in the order of 2×3 metres.

It is also known when producing stencils to illuminate a carrier substrate onto which a light-sensitive layer or a layer of emulsion has been applied with laser beams generated by laser equipment and to produce the pattern concerned by guiding movement of the laser beams along the cloth.

Practical application indicates that the laser method is well-suited for smaller stencils with limited print patterns, small dimensions with regard both to cloth and pattern image, although the requisite laser equipment and control (guide) unit demands a relatively high investment.

With regard to the production of polyester offset plates in particular it is known to coat the polyester material with a light-sensitive emulsion and to expose the emulsion with a pattern in essentially the same way as that described above with reference to stencils for stencil printing machines, and to develop the thus exposed plate so as to form the pattern.

SUMMARY OF THE INVENTION

Technical Problems

When considering the present standpoint of techniques, it will be seen that a technical problem resides in providing with the aid of simple means conditions whereby large stencils can be produced in a simpler manner, i.e. more quickly and with good resolution without requiring the use of relatively large projector equipment or laser equipment.

A technical problem also resides in using to this end a unit which is associated with its use in another technical field and to realize the minor constructional changes that are required to adapt said unit for application in the manner intended here.

When considering the present standpoint of techniques as described above, it will also be seen that a technical problem resides in realizing the possibilities that are afforded when a modified printing unit is used as a means for transferring digitally stored pattern-related information to a light-sensitive layer applied to a carrier substrate.

It will also be seen that a technical problem is one of realizing those advantages that are afforded in the manufacture of large stencils when the pattern is divided into different mutually parallel sections, each having a width corresponding to the effective width of one (or more) printing units, and to therewith produce section after section until the whole of the pattern has been produced on the carrier substrate.

It will also be seen that another technical problem is one of realizing the significance of and the advantages associated with allowing the printing unit to be movable backwards and forwards over a light-sensitive layer of emulsion, and by transferring section by section of the complete pattern digitally with the aid of computer equipment as a light-absorbent layer, for instance by applying a thin layer of carbon powder over the emulsion layer.

It will also be seen that a technical problem resides in realizing the advantages that are associated with the application of carbon powder subsequent to requisite exposure and fixation, and by washing away the non-hardened emulsion located beneath the carbon powder without soiling the surroundings to any significant extent.

A technical problem also resides in the provision of means which will enable carbon powder to be removed after fixing with the aid of subpressure prior to washing away solely nonhardened emulsion.

It will also be seen that a technical problem is one of realizing the significance of using an earlier known printing unit for the aforesaid purpose and for solving one or more of the aforesaid technical problems, and to modify this printing unit so that, to this end, a heating device normally used with the printer can be disconnected and an electrifying wire or roller applied to the opposite side of the carrier substrate or the cloth in relation to the printer in general.

It will also be seen that a technical problem resides in the ability to realize the significance and the simplicity of using two or more such modified printing units simultaneously, said units being conveniently laterally related and arranged for common movement relative to the layer-coated carrier-substrate.

It will also be seen that a technical problem is one of realizing the significance of supplementing the printing unit with position-determining means and allocating position-determining means to said unit so as to enable positioning in relation to registration to be controlled by a controlling unit, such as registration and positioning in relation to an adjacent part-pattern.

It will also be seen that a technical problem resides in realizing the significance of enabling the carrier substrate to move for registration between an already applied-related part-pattern and a part-pattern which is to be applied.

Solution

With the intention of solving one or more of the aforesaid technical problems, the present invention relates to a method and to apparatus for producing a stencil or an offset plate which is adapted to enable a pattern on the stencil to be transferred to print material as a print pattern by means of a printing process, wherein the stencil comprises initially a carrier substrate with a carrier-substrate associated pattern, while using digital information relating to the pattern and stored in computer equipment and while using means for transferring said digital information to a lightsensitive layer applied on the carrier substrate.

With a starting point from this known technique, it is proposed in accordance with the present invention that the computer equipment is connected to at least one modified printing unit, and that the printing unit is moved relative to the layer-coated carrier substrate while said unit applies to the light-sensitive layer a light-absorbent layer corresponding to said pattern, whereafter an exposure and a developing process may be carried out in a known manner to form said stencil.

According to preferred embodiments, two or more modified printing units are mutually coordinated and arranged side-by-side for common movement relative to the layer-coated carrier substrate.

It is also proposed that at least one printing unit shall be assigned position-determining means so as to provide precise positioning and registration, for instance relative to a part-pattern, through the medium of a position-regulating means or control unit.

In this regard, it is proposed that the carrier substrate can be moved by the position-regulating means so as to obtain precise registration between a part-pattern that has already been applied and a part-pattern which is to be applied.

It is also proposed that the printing unit can be moved in a horizontal direction.

Advantages

Those advantages that are primarily afforded by an inventive method and inventive apparatus reside in the provision of conditions whereby a large stencil (or a large offset plate) can be produced in a simple and inexpensive manner and also above all relatively quickly with a resolution of about 600 dpi, with the aid of a principly known, but slightly modified laser printing unit for applying to a carrier substrate coated with light-sensitive material a light-absorbing and pattern-forming layer by enabling the printing unit to move along the carrier substrate and therewith apply the complete pattern image in consecutive sections or partimages, said completed pattern image being exposed and developed after all pattern sections have been applied and a complete pattern has been formed.

BRIEF DESCRIPTION OF THE DRAWING

An embodiment of a stencil-producing apparatus according to an embodiment at present preferred and having features significant of the present invention will now be described in more detail with reference to the accompanying drawing, in which FIG. 1 is a perspective view of a horizontal stencil which includes a cloth stretched in a frame and coated with a light-sensitive layer, said stencil being shown in the process of a part-pattern allocated light-absorbing layer being applied by a modified printing; and FIG. 2 is a sectional view of a schematically illustrated printing unit used in the procedure.

DESCRIPTION OF AN EMBODIMENT AT PRESENT PREFERRED

FIG. 1 is thus a perspective view of an inventive arrangement which includes a horizontally positioned stencil frame 1 and equipment for applying a light-absorbing, pattern-forming layer section-by-section onto a light-sensitive layer.

Although the following description refers to the application of the light-absorbing, pattern-forming layer section-by-section until the complete pattern has been formed, it will be understood that when pattern images have a width which is smaller than the width of the printing unit used, the entire pattern can be accommodated in one single section.

In producing printed articles with the aid of a stencil that can be used in a stencil printing machine, the stencil comprises a frame 1 in which there is stretched a cloth 2 serving as a carrier substrate and a pattern 4 (A, A) formed in the cloth 2.

The characteristic features of the invention are illustrated in the following description with reference to a large frame and to a large pattern (A, A).

The cloth 2 is first coated with a light-sensitive layer or a layer of emulsion 3 of earlier known composition with the aid of means not shown.

It is also necessary to apply a pattern image (A, A), referenced 4, which can be created by coating the surface areas applicable to the actual pattern image 4 with a light-absorbing layer 5 and by allowing the surface regions 5' around said pattern image 4 to remain exposed in relation to the underlying layer 3.

In the case of a negative pattern image, it will be understood that the image 4 may be exposed while remaining surfaces 5' are covered with the light-absorbent layer 5.

The light-absorbing layer 5 is thus intended to prevent hardening of the underlying emulsion 3 within and beneath those surface regions in which the light-absorbing layer is located and to cause hardening of said layer within those surface regions that lack a covering light-absorbent layer, in a subsequent exposure process effected with the aid of lighting.

In a following developing process, the layer 5 is washed away together with the non-hardened emulsion 3 located therebeneath so as to produce the pattern image 4 (A, A), which is surrounded by hardened emulsion sections, wherein in a subsequent printing process ink paste is able to pass through the cloth within those regions thereof in which the meshes of the cloth are open, i.e. outwardly of (or inwardly of) the pattern image 4 (A, A).

In accordance with the present invention, a stencil is produced with the aid of computer equipment 10 and with the aid of digital information relating to the pattern and stored in the computer equipment principly in a known manner. The computer equipment 10 is connected by a cable 11 to means which enable the digital information to be transferred to form a light-absorbent layer 5 over the light-sensitive layer 3 earlier applied to the carrier substrate or to the cloth 2.

According to the invention, the computer equipment 10 is connected to at least one modified printer unit 20.

The printer unit 20 is fixed to a frame part 30 and can be moved reciprocatingly in the direction of the arrow P with the aid of movement transmitting means not shown. Movement of the printer unit to the left in FIG. 1 will result in application of the light-absorbing layer, whereas movement in the opposite direction is merely a return movement.

The printer unit 20 can thus be moved relative to the layer-coated 3 carrier substrate 2 through the medium of a frame part 30 and a stand part 31 while each movement to the left will result in the laser printer unit applying to the surface of the light-sensitive layer or to the surface of the carrier substrate a section of a light-absorbent layer relating to the complete pattern.

The means and procedures that follow in order to expose and develop the stencil are well known to the person skilled in this art and have not therefore been shown.

The invention also enables two or more similarly modified laser printer units 20, 20' to be mounted side-by-side in said frame part 30 for common movement in the direction P relative to the layer-coated carrier substrate.

The printer unit 20' is shown in broken lines in FIG. 1.

According to the present invention, at least one printer unit, such as the printer unit 20, at least when this unit is to apply the light-absorbent layer 5 on its own, is provided with an edge-related device which functions to position the printer unit 20 in relation to an earlier applied part-pattern for instance, this positioning being effected with the aid of a sensor 22 connected to the computer equipment 10 by a cable 11*a*.

In this way, the left-hand edge of the printer unit 20 for an applied part-section can be positioned precisely adjacent the right-hand edge of the adjacent part-section that has already been applied.

It is especially proposed that the carrier substrate 2 is capable of being moved into registration by a movement generating arrangement 41, 42, 43, 44, such as into registration between an already applied part-section and a part-section which is to be applied. Alternatively the printer unit 20 may be arranged for movement in the frame part 30 or in the stand part 31 both horizontally and transversely to the direction of the arrow P.

Another alternative is to allow the stand part 31 to coact with a movement generating means 51 or 52.

The arrangement can be controlled with the aid of circuits in the computer equipment 10.

The printer unit used may be a printer marketed by Texas Instruments, U.S.A., under the trademark MICROLASER PRO 600.

The modification or supplementation required to enable such a printer unit to be used in accordance with the invention resides in connecting or removing a heating coil intended for burning or baking-in powdered carbon.

It is also necessary to remove a de-electrifying roller, although measures may be taken to place this roller on the opposite side of the carrier substrate.

The thus modified printer unit is placed in the frame part 30.

If not removed, the de-electrifying roller is placed in the frame part 30' on the opposite side of the carrier substrate in relation to the printer unit 20.

Although not described in detail, means are provided for moving the printer unit 20 and the de-electrifying roller (or the wire) in unison.

FIG. 2 is a schematic sectional view of the laser printer unit 20.

Shown in FIG. 2 is a drum 25, a cleaning roller 26, a charge indicator 27, a pattern image exposing region 28, a developing region 29, and a region 25*a* in which the pattern is transferred to the layer 3, and a de-electrifying roller or wire 25*b* placed beneath the cloth 2.

Since the principle of a printer unit is known to the art, the unit will not be described in more detail here.

By printer unit is meant any type of unit which utilizes photo-electrographics and/or is based on the ability of producing a pattern with the aid of electromagnetic fields.

Such "printer units" may also include light-emitting diodes.

Instead of a light-absorbing layer, a light-reflecting layer or other means which provide the function of a photomask may be used.

It will be understood that the invention is not restricted to the aforedescribed and illustrated embodiment and that modifications can be made within the scope of the inventive concept as defined in the following Claims.

We claim:

1. A method of producing a stencil, the stencil including a carrier substrate and a pattern on the substrate, comprising the steps of:

applying a light-sensitive layer of material on a carrier substrate;

storing digital information corresponding to a pattern in computer equipment;

transferring the digital information to the light-sensitive layer applied on the carrier substrate by connecting to the computer equipment at least one printer unit, the printer unit being disposed relative to the carrier substrate such that the printer unit is on a side of the carrier substrate that has the light-sensitive layer thereon, the printer unit being a laser printer unit which has been modified by removing a heating coil for heating powdered carbon and by removing a de-electrifying roller, causing the at least one printer unit to move relative to the light-sensitive layer applied on the carrier substrate under control of the computer equipment, applying, with the at least one printer unit and under control of the computer equipment, a powdered carbon masking layer corresponding to the pattern to the light-sensitive layer applied on the carrier substrate to form a masked pattern wherein some of the light-sensitive material is masked by the masking material and some of the light-sensitive material is not masked by the masking material, exposing the masked pattern to light such that the light-sensitive material not covered by the masking material is exposed to light, and removing the masking material and the light-sensitive material masked by the masking material.

2. A method according to claim 1, wherein the computer equipment controls movement of two or more printer units in side-by-side relationship.

3. A method according to claim 2, wherein a positioning means senses a position of the at least one printer unit relative to the masked pattern and communicates the position of the at least one printer unit to the computer equipment.

4. A method according to claim 1, wherein a positioning means senses a position of the at least one printer unit relative to the masked pattern and communicates the position of the at least one printer unit to the computer equipment.

5. A method according to claim 4, comprising the further step of moving the carrier substrate to register a masked pattern to be applied with a masked pattern that has already been applied.

6. A method according to claim 1, wherein the printer unit is moved horizontally.

7. A stencil-producing arrangement for producing a stencil including a carrier substrate having a pattern thereon, comprising:

computer equipment for storing digital information corresponding to a masking pattern to be applied to a carrier substrate having a light-sensitive layer thereon to form a stencil;

at least one printer unit connected to the computer equipment, the printer unit being disposed relative to the carrier substrate such that the printer unit is on a side of the carrier substrate that has the light-sensitive layer thereon, the printer unit being a laser printer unit which has been modified by removing a heating coil for heating powdered carbon and by removing a de-electrifying roller;

a movable frame part to which the at least one printer unit is mounted for moving the at least one printer unit relative to the carrier substrate;

wherein the computer equipment is adapted to control both movement of the frame part and operation of the at least one printer unit such that the printer unit is moved and operated to apply a powdered carbon masking layer to the light-sensitive layer and form the masking pattern.

8. An arrangement according to claim 7, wherein two or more laser printer units are disposed in side-by-side relationship on the frame part and move in unison with the frame part.

9. An arrangement according to claim 8, wherein the at least one printer unit includes means for positioning the at least one printer unit relative to the masking pattern.

10. An arrangement according to claim 7, wherein the at least one printer unit includes means for positioning the at least one printer unit relative to the masking pattern.

11. An arrangement according to claim 10, further comprising means for moving the carrier substrate under control of the computer equipment.

12. An arrangement according to claim 11, wherein the computer is adapted to control the moving means to move the carrier substrate into a position of registration between an already applied masking pattern and a masking pattern to be applied.

13. An arrangement according to claim 7, wherein the movable frame part is arranged to permit horizontal movement of the at least one printer unit.

14. An arrangement according to claim 6, further comprising a de-electrifying device disposed on a side of the carrier substrate opposite the at least one printer unit.

* * * * *